United States Patent [19]

Belles

[11] 4,284,844

[45] Aug. 18, 1981

[54] LOUDSPEAKER SYSTEM

[75] Inventor: David E. Belles, Pittsford, N.Y.

[73] Assignee: Belles Research Corp., East Rochester, N.Y.

[21] Appl. No.: 36,613

[22] Filed: May 7, 1979

[51] Int. Cl.[3] ..... H04R 1/26; H04R 1/28

[52] U.S. Cl. ..... 179/1 E; 179/146 E; 179/180; 181/151; 181/199

[58] Field of Search ..... 179/1 E, 180, 146 E; 181/199, 156, 151, 148, 147, 146, 145, 144

[56] References Cited

U.S. PATENT DOCUMENTS

| | | | |
|---|---|---|---|
| 1,988,250 | 1/1935 | Olson | 181/147 |
| 3,578,103 | 5/1971 | Lennes | 181/156 |
| 4,008,374 | 2/1977 | Tiefenbrun | 179/1 E |
| 4,139,734 | 2/1979 | Fincham | 179/1 E |
| 4,161,995 | 7/1979 | Pohlmann et al. | 181/199 X |
| 4,169,516 | 10/1979 | Honda | 181/199 X |
| 4,182,931 | 1/1980 | Kenner | 179/1 E |

FOREIGN PATENT DOCUMENTS

| | | | |
|---|---|---|---|
| 1458536 | 11/1966 | France | 179/1 E |
| 21267 | 5/1961 | German Democratic Rep. | 181/148 |
| 434563 | 9/1935 | United Kingdom | 181/151 |

OTHER PUBLICATIONS

"Direct Radiator Loudspeaker Enclosures", Harry F. Olson, *Audio Engineering,* Nov. 1951, pp. 34–36.

*Primary Examiner*—Thomas W. Brown
*Attorney, Agent, or Firm*—Martin LuKacher

[57] ABSTRACT

A loudspeaker system makes use of a closed cubic enclosure the front of which is a square baffle having tapered edges, the intersections of which fit the outline of an imaginary sphere which substantially encompasses the enclosure. Wide dispersion of audible acoustic waves of low frequency with a minimal amount of diffraction from a woofer loudspeaker mounted in the baffle at the convergence of the tapered edges occurs. A tweeter is mounted in substantially freely spaced relationship with the enclosure to provide also for wide dispersion of acoustic waves of high frequency. The enclosure is tuned to enhance the low end of its frequency response. A semirigid foam front panel having beveled edges is disposed on the baffle over the woofer and acts as an acoustically transparent front grill for the system. The tweeter is encased in acoustically transparent material mounted on the top of the enclosure. The system has a uniform frequency response over the entire audible band and gives the image to the listener of an acoustic source of a size much larger than the actual size of the system.

21 Claims, 6 Drawing Figures

LOUDSPEAKER SYSTEM

DESCRIPTION

The present invention relates to loudspeaker systems and particularly to a loudspeaker system having loudspeaker mounting arrangements, including an enclosure, which improves the frequency response of the system and provides the listener with the acoustic image that the sounds being perceived emanate from a much larger and deeper area than occupied by the enclosure.

The invention is especially suitable for use in providing loudspeaker systems for the high fidelity reproduction of musical performances, both monaurally and stereophonically.

The invention adds the dimension of depth to the reproduction of sound, which is lacking in sound reproduced with conventional loudspeaker systems which is perceived as emanating from a flat surface.

In spite of the many loudspeaker systems which are being marketed, the price of loudspeaker systems, which do not introduce distortion that is perceived by the keen listener as coloration, is beyond the reach of most consumers. The size of such speaker systems, as well as their price, also prevents them from being useful in the home of the typical consumer. For example, such speaker systems have cabinets over six feet high and two feet wide. Two or more cabinets are used in a stereo system (see High Fidelity Magazine for October 1978, Pages 66 to 68). It is believed that the coloration of the reproduced sound, as may be manifested by an irregular frequency response of the system, results from reflected waves, especially at low frequencies. These waves may resonate or interfere with directly radiated and other reflected waves. The listener may perceive a delay or time differential between the direct and reflected waves as composite sounds which are not clear and appear to emanate from a flat surface or a confined space or box. The sound waves which reflect back from the loudspeaker system also gives the acoustic image or perception of a confined source of the sound, rather than a large area source, such as the orchestra which may actually have created the sounds.

In an effort to provide the desired acoustic image and eliminate colorations, loudspeaker systems have attempted the use of multiple loudspeakers which radiate out of two or more opposite sides of an enclosure. The speakers are actively driven in an effort to distribute the sounds. In some cases the speakers are driven in phase so as to prevent reflections and interferences. Coupling between the speakers is undesirable, and attempts to eliminate such coupling involve stuffing the region between the speakers with acoustical absorbing material. For further discussion of these loudspeaker systems with two or more pairs of driven loudspeakers, reference may be had to the following U.S. Pat. Nos.: Gerlach, 1,667,149 issued Apr. 24, 1928; Cool, 3,074,503, issued Jan. 22, 1963; Magnus, 3,268,030 issued Aug. 23, 1966; Globa, 3,590,942 issued July 6, 1971; Tiefenbrun, 4,008,374 issued Feb. 15, 1977; and McKenzie, 3,590,941 issued July 6, 1971.

Loudspeaker systems have also attempted to use ducted enclosures which act as resonators and speakers driven and oriented to produce reflected waves advertently reflected from portions of the enclosure or its surroundings. For reference to such speaker systems see the Cool and McKenzie patents mentioned above and Robbins, U.S. Pat. No. 2,694,462 issued Nov. 16, 1954, and Ostrander, U.S. Pat. No. 4,130,174 issued Dec. 19, 1978.

Enclosures for loudspeaker systems have also been designed with the intent of reducing reflections (see the text "High performance Loudspeakers", by Martin Cholloms, John Wiley and Sons, New York (1978), Page 181; and Audio Magazine, Vol. 62, No. 10, October 1978, Page 45).

In accordance with the invention sound, especially at low frequencies (bass), is obtained from the front or baffle of the enclosure where the driven loudspeaker is mounted. The baffle at the front of the enclosure is beveled and fits the outline of an imaginary sphere which also encompasses the entire enclosure. The system provides for reproduction of sound with a minimum of coloration. A passive radiator or drone cone may be mounted at the rear of the enclosure, opposite to the driven loudspeaker to enhance the low end response. The frequency response characteristic of the system is uniform, even in the low frequency (bass) region thereof.

Psychoacoustically, the system is perceived by the listener as a large area sound source. The enclosure is of reasonable size and can be marketed at a cost within the range of the typical consumer of high fidelity sound systems.

Accordingly, it is an object of the present invention to provide an improved loudspeaker system.

It is another object of the present invention to provide an improved loudspeaker system with a frequency response which is essentially uniform and free of irregularities over the entire audio frequency range of interest, and especially at low audio (bass) frequencies.

It is a further object of the present invention to provide an improved loudspeaker system in which wide dispersion of sounds in the lower portion of the frequency range of the system (below for example about 2500 Hz) is permitted, such that reflection, diffraction and interference of such low frequency sound waves which can be perceived as undesirable coloration by the listener can be avoided.

It is a still further object of the invention to provide an improved loudspeaker system which provides the psychoacoustic effect of a larger and especially a deeper sound source (viz., give the listener the sonic image of a source larger than its actual size with the dimension of depth).

It is a still further object of the present invention to provide an improved loudspeaker system which gives the effect of a sonic image much larger and deeper than the actual size of the system without the need for multiplicity of speakers which radiate in opposite directions as from the front, rear and sides of an enclosure.

It is a still further object of the present invention to provide an improved loudspeaker system with a grill or covering over the speaker unit which imparts a pleasing visual effect or appearance without interfering with the reproduction of sound.

It is a still further object of the present invention to provide an improved loudspeaker system which obtains broadband output into the mid-range from the woofer speaker without sacrificing low frequency or bass response from the woofer.

It is a still further object of the present invention to provide an improved loudspeaker system which affords enhanced low frequency (bass) response without special ducts or resonators.

More particularly, a loudspeaker system embodying a presently preferred form of the invention has a generally cubic enclosure. A driven loudspeaker is mounted in an opening in a baffle which provides the front end of the enclosure. The front end baffle is generally square. Each edge of the baffle is inwardly tapered to converge at the opening in which the speaker is mounted. The intersections of the tapered edges define points along the outline of a spherical surface. This surface substantially surrounds the entire enclosure. A tweeter is mounted, substantially freely suspended above the top of the enclosure and permits wide dispersion of the higher frequency sound and a more open (large and deep area source) perception of the sounds, even at the higher frequencies. The tweeter may be mounted on top of the enclosure in an acoustically transparent covering. One or more mid-range speakers may be disposed between the tweeter and the enclosure. It is a feature of the invention that the loudspeaker in the enclosure may be operated as a woofer which covers the mid-range and has a crossover with the tweeter at about 2600 Hz; thus avoiding the need for mid-range speakers. The enclosure is desirably mounted so as to provide free space in the rear thereof and around its top , bottom, and sides, as well as the front thereof, so that the wide dispersion, without reflection of sounds produced by the woofer results. A pedestal is used to provide such a mounting for the enclosure.

The foregoing and other objects, features and advantages of the invention as well as a presently preferred embodiment thereof will become more apparent from a reading of the following description in connection with the accompanying drawings in which.

Figure 2:
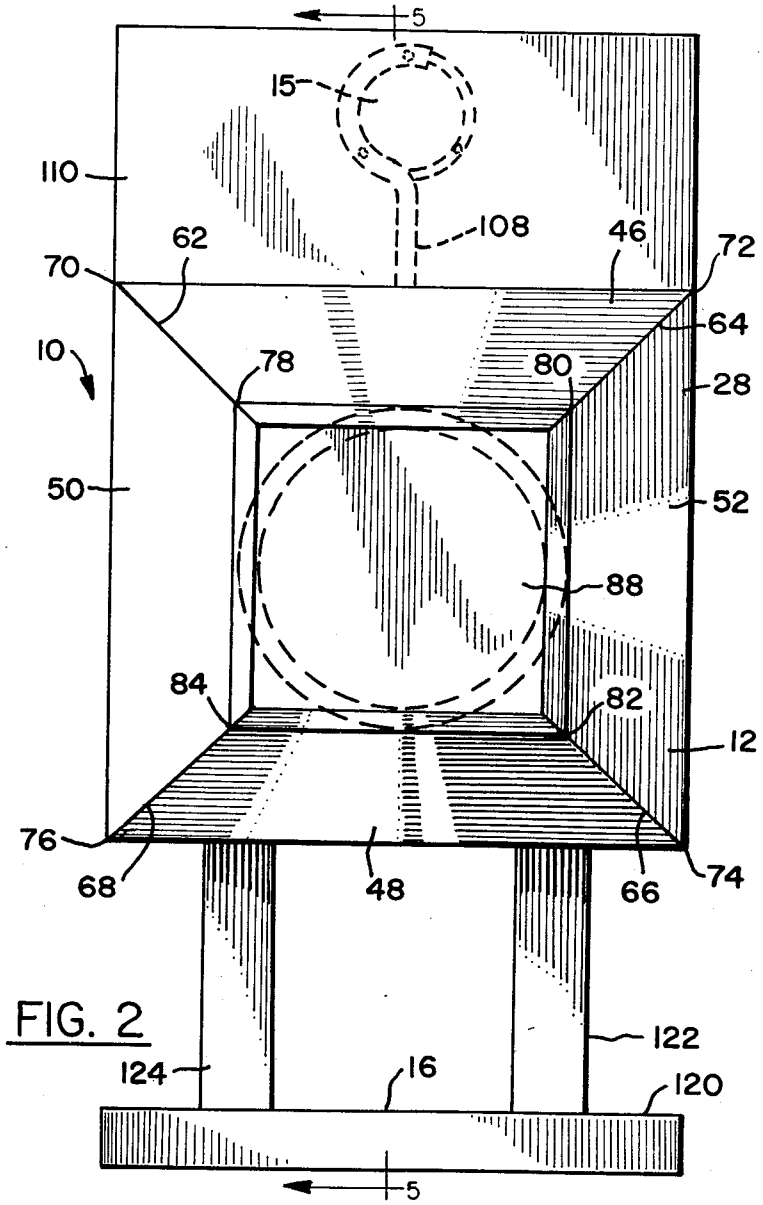
FIG. 2 is a front end view of the system shown in FIG. 2.
Figure 1:
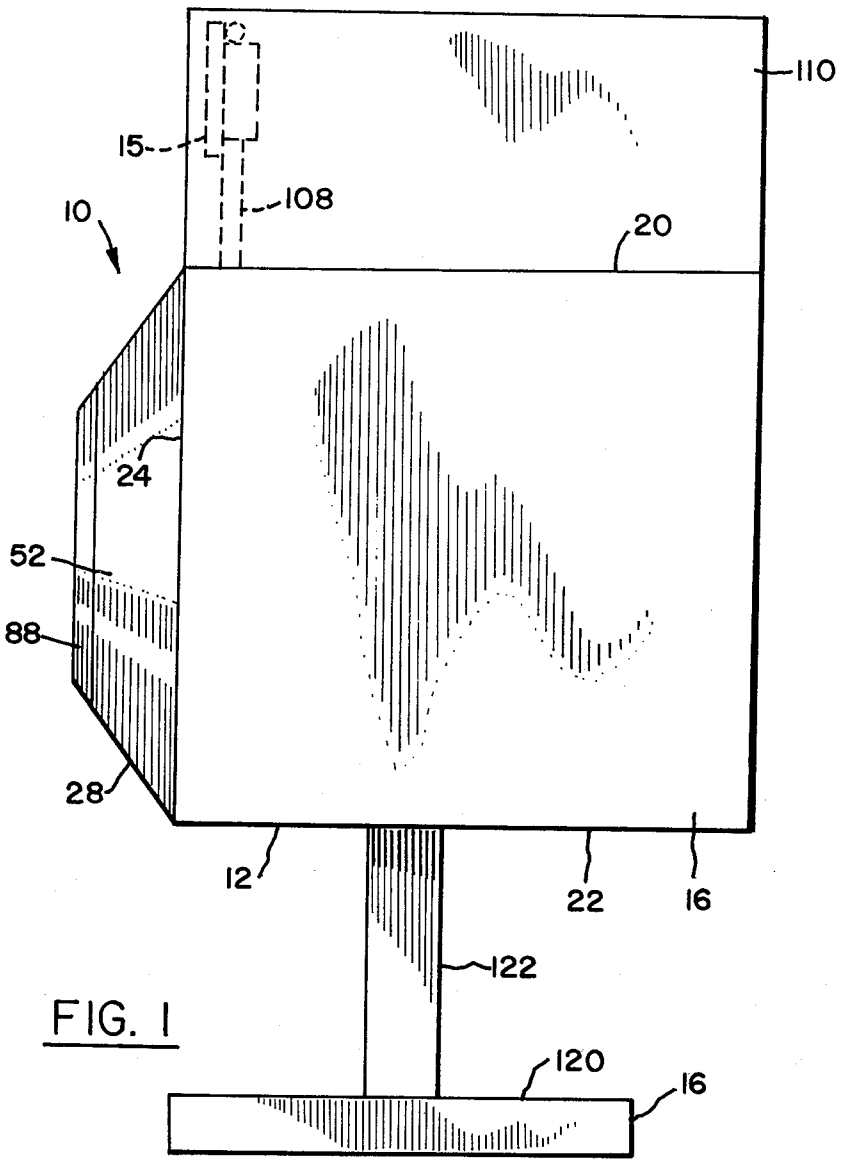
FIG. 1 is a side view of a loudspeaker system embodying the invention.
Figure 4:
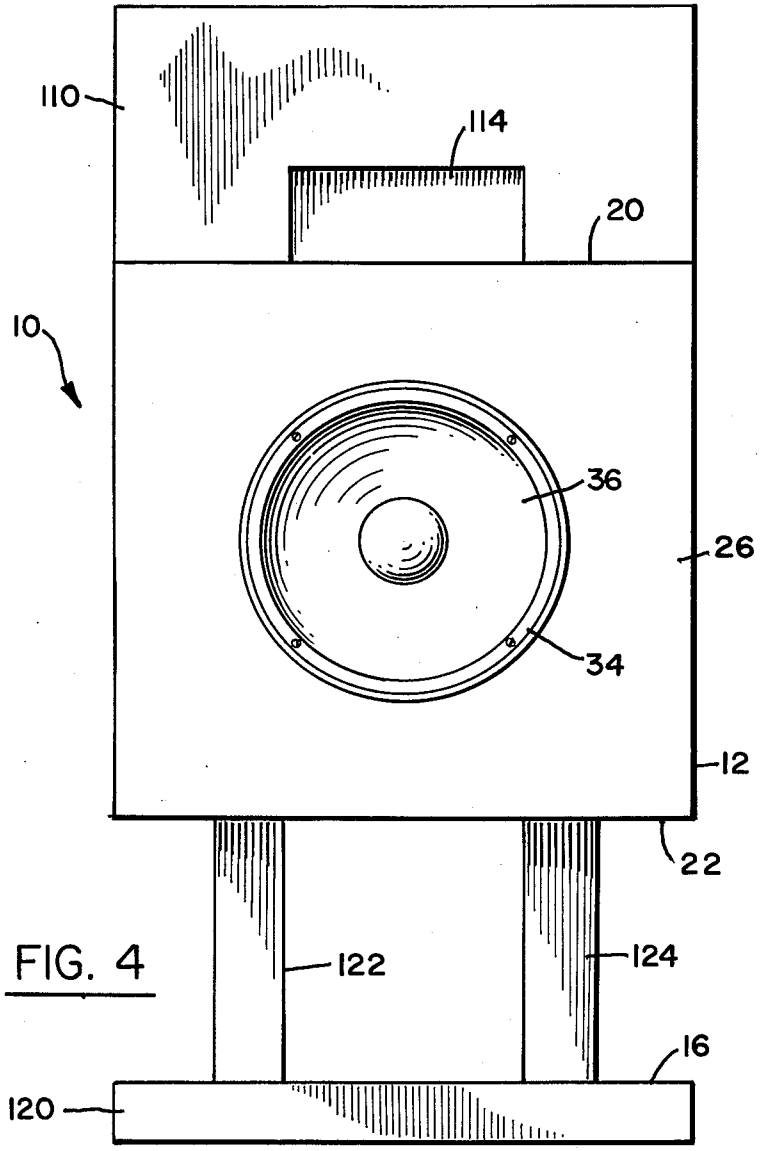
FIG. 4 is a top view of the system shown in FIGS. 1, 2 and 3.
Figure 3:
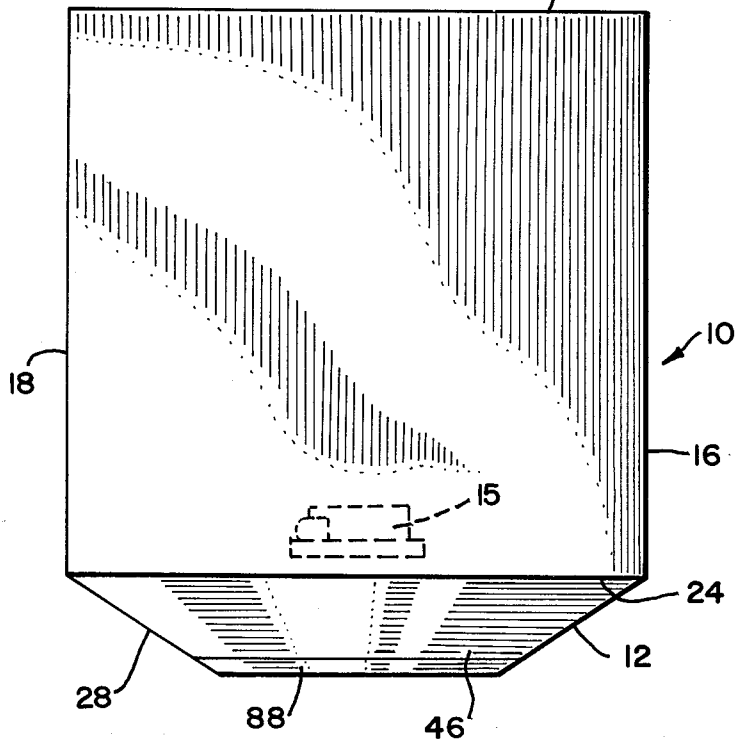
FIG. 3 is a rear end view of the loudspeaker system shown in FIGS. 1 and 2.

Referring to FIGS. 1 to 5 of the drawing there is shown a loudspeaker system 10 made up of an enclosure 12 for a low frequency or woofer loudspeaker 14 and its associated components, a high frequency or tweeter loudspeaker 15 and a pedestal assembly 16 which supports the enclosure 12, the tweeter 15 and its accessories.

Although it is a feature of this invention to provide a loudspeaker system having a uniform response and an improved sound reproduction ability without the need for mid-range speakers, such speakers may be provided, if desired. They would be provided in an enclosure of design similar to the enclosure 12 in vertically stacked relationship between the enclosure 12 and the tweeter 15.

The enclosure 12 is cubic in form in this embodiment of the invention. It may however, be made somewhat rectangular with its sides 16, 18 and its top and bottom 20, 22, larger than its front and rear ends 24, 26. The front and rear ends 24, 26, are squares even when the enclosure is rectangular. Typically, the enclosure 12 may be 15″×15″×15″. The front end of the enclosure is closed by a baffle 28 having a central opening 30 in which the driven woofer loudspeaker 14 is mounted. The rear end 26 of the speaker has an opening 32 in which a passive radiator or drone cone 34 is mounted. The passive radiator is a loudspeaker having a cone 36 suspended in a frame 38 but without an electromagnet or other driver assembly as in the case of a driven loudspeaker. The drone cone is the same size (diameter) as the cone 40 of the woofer loudspeaker and the holes 30 and 32 may also be of the same diameter. The drone cone and its opening may be larger in diameter than the woofer loudspeaker and its mounting hole 30.

The enclosure is preferably made of dense material such as wood particle board with the joints sealed so as to provide a sealed enclosure except at the openings 30 and 32. Even at these openings, the enclosure is sealed by the cones 36 and 40 and gaskets or putty seals 42 and 44 between the rims, of the frames of woofer speaker 14 and drone cone 34, and shoulders in the openings 30 and 32 (see FIG. 5).

The baffle 28 at the front end 24 of the enclosure is generally square and has edges which are inwardly tapered toward the opening 30. These tapered edges may also be termed beveled edges 46, 48, 50 and 52.

Figure 5:
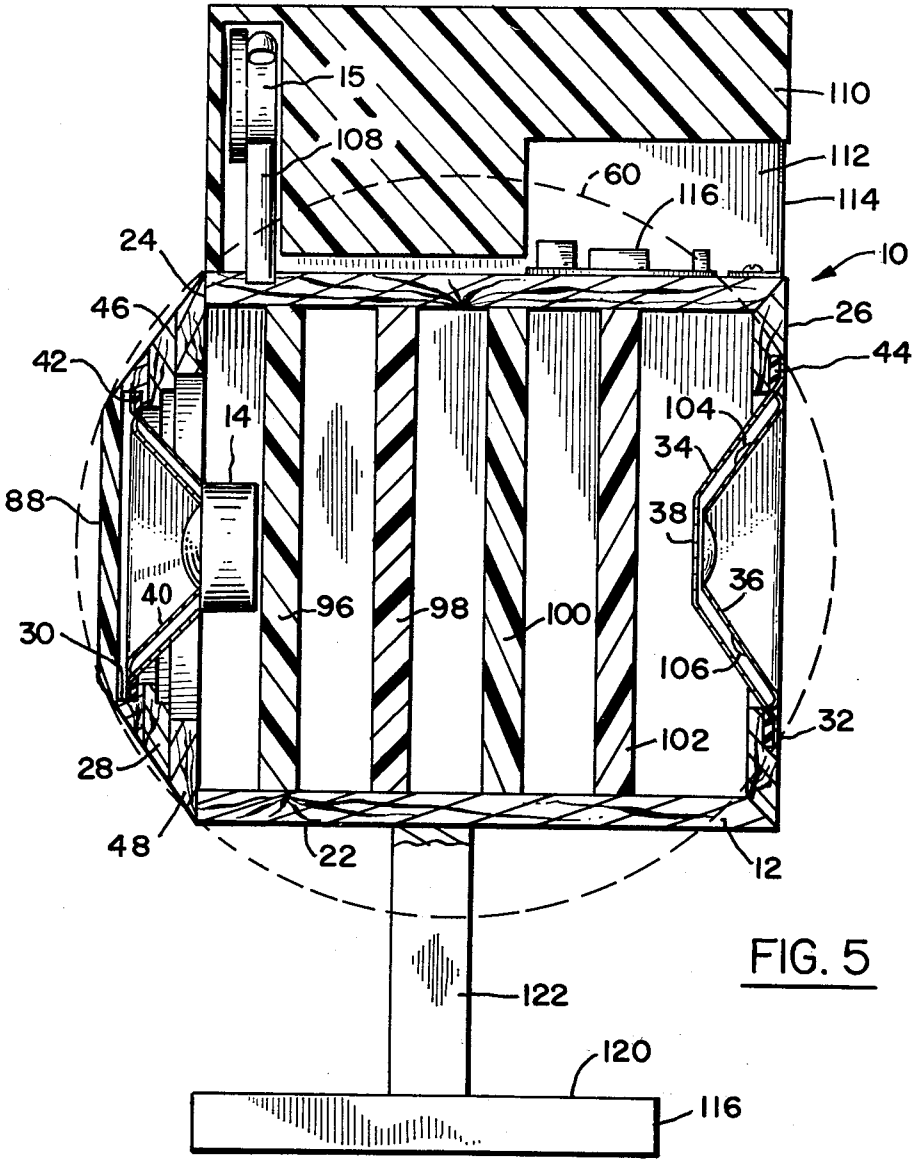
FIG. 5 is a sectional view of a loudspeaker system shown in FIGS. 1 to 4, the section being taken along the line 5—5 in FIG. 2.

An imaginary sphere 60 substantially surrounds the enclosure 12 (see FIG. 5). The beveled edges 46, 48, 50 and 52 have intersections 62, 64, 66 and 68 (see FIG. 2). These intersections define points along the outline of the surface of the sphere 50. These points are at least the outermost ends 70, 72, 74 and 76 of the intersection as shown in the drawings. The degree of taper or bevelling may be somewhat less than shown in the drawings, in which case the innermost ends 78, 80, 82 and 84 of the intersections may define points along the surface of the sphere 50.

A panel or grill 88 having beveled edges complementary to the beveled edges 46, 48, 50 and 52 of the baffle 28 is attached to the baffle over the opening 30. This grill 88 is square, as shown in FIG. 2, and is of dimensions approximately equal to the dimensions of the other face of the front end of the enclosure 12 which is defined by the convergence of the tapered or beveled edges 46, 48, 50 and 52. The complementary bevelling of the edges of the grill 88 to the beveled edges of the baffle 28 enhance the styling of the system and provides a pleasing appearance. The material of the grill 88 may be an acoustically-transparent foam. The foam may be polyester or polyurethane foam which is of open cell or reticulated construction. The density of the foam is such that it is transparent to acoustic waves over the entire operating band of the loudspeaker system (20 to 20,000 Hz). Such foams are generally available on the market and have been used in loudspeaker systems (see the above referenced patent to Ostrander, U.S. Pat. No. 4,130,174). The conventional frame structure with grill cloth stretched across the frame is avoided, since it has been found to tend to interfere with the reproduced sound waves.

Figure 6:
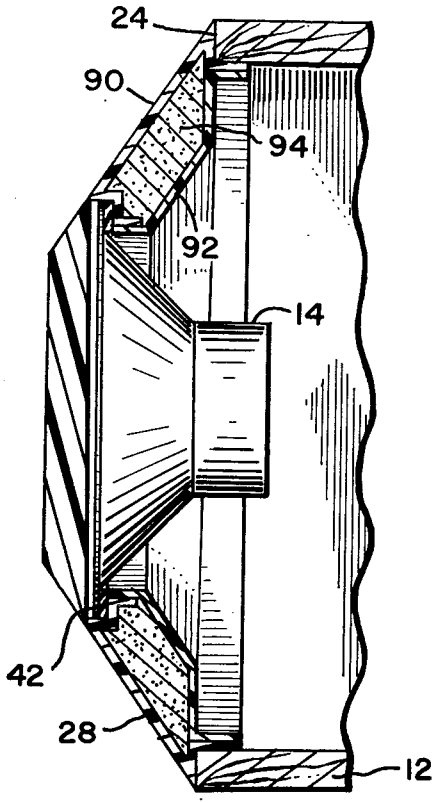
FIG. 6 is a sectional view illustrating a baffle constructed in accordance with another embodiment of the invention, which baffle may be used in place of the baffle shown, particularly in FIG. 5.

The baffle 28 is designed to provide a high acoustic mass so as to de-couple the woofer loudspeaker 14 from the enclosure. To this end the baffle may be made from a laminated assembly of sheets of high density wood fiber containing material, such as particle board. Three such boards are shown laminated together in FIG. 5. Alternatively, and as shown in FIG. 6, the baffle 28 may be made of an outer part 90 and an inner part 92 of plastic material which have overlapping rims. These rims are sealed together to define a closed shell. Prior to sealing, the shell is filled with high density material such as sand 94.

Within the enclosure 12 and between the driven loudspeaker 14 and the passive radiator 34 there are means for reducing standing waves and resonant conditions in the enclosure without affecting the tuning of the enclosure at the low end of the frequency range. Also sound waves which might pass through the cone 40 of the woofer 14 are absorbed. Coloration of the reproduced sound by such waves is thereby avoided. These means are exemplified by a plurality of square panels 96, 98, 100 and 102. These panels have the same outside dimensions as the inside dimensions of the enclosure and are arranged perpendicularly to the top and bottom 20 and 22 thereof. The panels are preferably of semi-rigid and self supporting foam material, such as polyester foam having a reticulated construction similar to the foam used for the front grill 88. The foam, however, is of greater density, say 2 to 4 pounds per cubic foot. The panels attenuate lower frequency waves less than higher frequency waves and frequencies below about 100 Hz are transmitted without substantial attenuation. While four panels, as illustrated in FIG. 5 have been found suitable for the purpose, one or more of such panels may be used. The orientation and disposition in the enclosure may also be varied to optimize the design.

The low frequency response is enhanced by virtue of the drone cone or passive radiator 34 which tunes the enclosure so as to provide an acoustic resonant frequency in the lower end of the response. The drone cone is preferrable to a vent since it reduces the emanation of waves which might color the reproduced sound and avoids wind-like or pipe sounds produced by vents. The resonant frequency may suitably be 40 Hz. In the event that the cone does not present a sufficient acoustic impedance (in this case a stiffness) to resonate the enclosure at the desired frequency, a mass of material such as the plurality of bodies 104, 106 of putty may be attached to the cone 36 on the inner side thereof. In summary, the resonant frequency of the enclosure is provided by adjusting the mass of the drone cone which presents an acoustic impedance to the enclosure such that the enclosure with the speaker and the drone cone are resonant at the frequency in the low end of the response (e.g., 40 Hz).

The tweeter 15 is suspended in freely spaced relationship by mounting means which provides minimal interference with the wide dispersion of the high frequency sound reproduced by the tweeter, to this end the tweeter is mounted by means of a bracket 108 to the top 20 of the enclosure 12. The bracket 108 may be a rod having a goose neck at the top thereof to which the flange of the tweeter 15 is attached. The tweeter is encased in a block 110 of acoustically transparent material, such as the same material as is used for the front grill 88. This block effectively provides the grill for the front of the tweeter 15 and lends itself to impart a pleasing appearance to the entire system.

A compartment 112 in the rear end of the block 110 is closed by a cover 114 also attached to the top 20. An electronic circuit which may be the crossover circuit assembly 116 is mounted on the top 20 of the enclosure in the compartment 112. This crossover network may consist of a low pass filter connected between the input terminals thereto and the woofer and a high pass filter connected between these input terminals and the tweeter 15. The high pass filter may be terminated by an 8 ohm pad (viz., a resistive T or L network) of impedance which matches the impedance of the crossover network filter. The system enables the woofer to cover much of the mid-range of the frequency response of the system and the tweeter to cover the remaining portion of the mid-range as well as the high frequency range of the response. A suitable crossover frequency may be about 2700 Hz (say 2666 Hz). At that crossover frequency the amplitudes of the driving signals applied to the woofer and tweeter will be equal. Below this crossover frequency (about 2700 Hz in this example) the amplitude of the signals applied to the tweeter increase with increasing frequency thereof, while the signals applies to the woofer increase in amplitude with decreasing frequency. Preferably the crossover network 116 is designed so that the increase and decrease is at a rate of about 18 dB per octave. The acoustic design of the system permits such a sharp variation, which is known as roll-off, which avoids interaction between the speakers while providing a uniform frequency response over the entire range.

The pedestal assembly 16 consists of a base 120 and a pair of legs 122 and 124. The cross sectional area of the legs as presented to the front end of the enclosure is much less than the area of the front end. The purpose of the pedestal is to provide for floor mounting of the system and to support the enclosure freely spaced from its surroundings. This enables the dispersion of acoustic waves around the front end of the enclosure, that is around the baffle 28 and toward the rear of the enclosure without significant interference, as by reflections from the legs 122 and 124. Other means for suspending the enclosure, such as legs or wire suspension may also be used. The pedestal is preferred in cases where floor mounting is desired. The beveled baffle together with the disclosure of dimensions so as to substantially fit within the outline of the sphere contributes to the prevention of reflection and the avoidance of diffraction or other interference with the sound radiated by the loudspeaker 14. At low frequencies such sound is substantially non-directive. By means of the structure of the enclosure, and especially the baffle 28, wide dispersion of the radiated sound is permitted. The resulting effect is that of a sound source of much larger size than the system 10. Coloration of the reproduced sound as may be caused by such interference effect is also avoided by reason of the beveled baffle 28 and the enclosure which fits substantially within the outline of the sphere 60.

From the foregoing description it will be apparent that there has been provided an improved loudspeaker system. A presently preferred embodiment of the system has been described in detail in order to illustrate the invention. Variations and modifications of the hereindescribed system, within the scope of the invention, will undoubtedly suggest themselves to those skilled in the art. Accordingly, the foregoing description should be taken as illustrative and not in any limiting sense.

I claim:

1. A loudspeaker system comprising a generally cubic enclosure having front and rear ends, openings in said ends, a loudspeaker mounted in said front end opening to radiate outwardly from said enclosure, and said front end being a generally square baffle, each edge of which is inwardly tapered toward said front end opening, the intersections of said tapered edges defining points along the outline of an imaginary spherical surface which substantially surrounds said enclosure.

2. The invention as set forth in claim 1 further comprising a passive radiator in said rear end opening, said loudspeaker and radiator being in sealed relationship with said front and rear ends.

3. The invention as set forth in claim 1 further comprising at least one additional speaker operative over a frequency band higher than said loudspeaker, and means for mounting said additional speaker in freely suspended relationship from said enclosure.

4. The invention as set forth in claim 3 further comprising a body of substantially acoustically transparent material enclosing said additional speaker.

5. The invention as set forth in claim 3 wherein said additional speaker is disposed upon the top side of said enclosure to radiate in the same direction as said loudspeaker.

6. The invention as set forth in claim 3 wherein said additional speaker is a tweeter and said loudspeaker is a woofer, and means for driving said woofer and tweeter with electrical signals which respectively decrease and increase in amplitude with frequency such that a signal at a frequency in the upper mid-range of the audio spectrum, such as of about 2600 Hz, drives both said tweeter and woofer with equal amplitude.

7. The invention as set forth in claim 6 wherein said driving means includes means for providing said increase and decrease at a rate of about 18 dB per octave.

8. The invention as set forth in claim 2 wherein said loudspeaker is a woofer having a response in the lower frequency region of the frequency response of said system, said passive radiator comprising a drone cone having an acoustic impedance such that said system of said enclosure with said speaker and drone cone are resonant at a frequency in the lower end of said response, such as 40 Hz.

9. The invention as set forth in claim 8 further comprising means for providing said drone cone with a mass operative to tune said system to be resonant at said frequency.

10. The invention as set forth in claim 1 further comprising means attached to said enclosure for supporting said enclosure freely spaced from its surroundings with the front and rear ends thereof vertical, said loud speaker having an axis disposed horizontally to enable the dispersion of acoustic waves horizontally outward from and around the front end and along each side of said enclosure toward the rear end thereof.

11. The invention as set forth in claim 10 wherein said supporting means comprises a pedestal attached to the bottom side of said enclosure for floor mounting said enclosure.

12. The invention as set forth in claim 11 wherein said pedestal has leg means, the cross sectional area of which in a plane parallel to the front end is much less than the area of said front end.

13. The invention as set forth in claim 1 wherein said baffle contains material of density sufficient to present an acoustic mass much greater than the acoustic mass of said loudspeaker such that said speaker is isolated from said enclosure when mounted in said baffle.

14. The invention as set forth in claim 13 wherein said material contains wood and is of a thickness a plurality of times as thick as the walls of said enclosure other than said front wall provided by said baffle.

15. The invention as set forth in claim 14 wherein said baffle comprises a laminated assembly of sheets of high density wood fiber containing material, such as wood flake board.

16. The invention as set forth in claim 13 wherein said baffle comprises at least two parts attached to each other to define a closed shell, and sand filling said shell.

17. The invention as set forth in claim 16 wherein said parts are plastic material having overlapping edges deposed in sealed relationship with each other.

18. The invention as set forth in claim 1 further comprising a panel of substantially acoustically transparent material of dimensions approximately equal to the dimensions of the outer face of said front end which is defined by the convergence of said tapered edges of said baffle, said panel being mounted on said outer face over said opening in said baffle.

19. The invention as set forth in claim 18 wherein said panel material is foam of such density as to be transparent to acoustic waves over the operating band of said system.

20. The invention as set forth in claim 1 further comprising filter means within said enclosure between said loudspeaker and said radiator for reducing standing waves in said enclosure.

21. The invention as set forth in claim 20 wherein said filter means comprises at least one panel of foam material of density which is absorptive of acoustic waves at all frequencies within the acoustic range excepting below about 100 Hz.

* * * * *